US005274205A

United States Patent [19]

Tsukushi et al.

[11] Patent Number: 5,274,205

[45] Date of Patent: Dec. 28, 1993

[54] GAS BLAST, PUFFER TYPE CIRCUIT BREAKER WITH IMPROVED NOZZLE

[75] Inventors: Masanori Tsukushi; Akira Hashimoto; Minori Satoh; Yukio Kurosawa; Kunio Hirasawa; Fumihiro Endo; Tokio Yamagiwa, all of Hitachi, Japan

[73] Assignee: Hitachi, Ltd., Tokyo, Japan

[21] Appl. No.: 37,529

[22] Filed: Mar. 26, 1993

Related U.S. Application Data

[63] Continuation of Ser. No. 735,837, Jul. 25, 1991, abandoned.

[30] Foreign Application Priority Data

Aug. 3, 1990 [JP] Japan ..... 2-205003

[51] Int. Cl.[5] ..... H01H 33/88

[52] U.S. Cl. ..... 200/148 A

[58] Field of Search ..... 200/148 R, 148 A, 148 B, 200/148 C, 148 G

[56] References Cited

U.S. PATENT DOCUMENTS

| | | | |
|---|---|---|---|
| 4,144,426 | 3/1979 | Kowalik et al. | 200/148 A |
| 4,320,270 | 3/1982 | Graf et al. | 200/148 A |
| 4,327,262 | 4/1982 | Kull | 200/148 A |
| 4,418,256 | 11/1983 | Graf | 200/148 R |
| 4,420,662 | 12/1983 | Niemeyer et al. | 200/148 R |
| 4,471,185 | 9/1984 | Kinsinger | 200/148 R |
| 4,489,226 | 12/1984 | Holmgren et al. | 200/148 A |
| 4,562,322 | 12/1985 | Yamaguchi et al. | 200/148 G |
| 4,667,072 | 5/1987 | Endo et al. | 200/148 A |
| 4,791,256 | 12/1988 | Yonezawa et al. | 200/148 R |
| 4,841,108 | 6/1989 | Hamm | 200/148 A |

FOREIGN PATENT DOCUMENTS

| | | |
|---|---|---|
| 135158 | 8/1984 | European Pat. Off. . |
| 191465 | 2/1986 | European Pat. Off. . |
| 3535194 | 7/1986 | Fed. Rep. of Germany . |
| 2072467 | 8/1971 | France . |
| 2473777 | 1/1981 | France . |
| 57210507 | 12/1984 | Japan . |

OTHER PUBLICATIONS

IEEE Standard Handbook for Electrical Engineers; Section 4–Properties of Materials–Table 4–59–; p. 4–138; 1969.

*Primary Examiner*—J. R. Scott

*Attorney, Agent, or Firm*—Antonelli, Terry, Stout & Kraus

[57] ABSTRACT

A gas blast circuit breaker comprises an insulation nozzle for blowing extinguishing gas to an arc generated between a stationary contact and a movable contact. The nozzle has a throat section into and out of which one of the two contacts is movable and a divergent section provided downstream of the throat section. A slanting surface for increasing a reflectivity of energy intensity of the arc is formed on the divergent section of the nozzle. The nozzle is formed of a fluoroplastic material and boron nitride powder of not more than 15 vol. % is added as a filler.

6 Claims, 3 Drawing Sheets

GAS BLAST, PUFFER TYPE CIRCUIT BREAKER WITH IMPROVED NOZZLE

This application is a continuation of application Ser. No. 07/735,837, filed Jul. 25, 1991 now abandoned.

BACKGROUND OF THE INVENTION

This invention relates to a gas blast circuit breaker and more particularly to a gas blast circuit breaker provided with an insulation nozzle disposed in the vicinity of an arc generating section so as to blast extinguishing gas, such as $SF_6$ gas, to an arc generated between a movable contact and a stationary contact when large electric current is interrupted.

Recently, with an increasing consumption of electric power, electric devices have been required to operate under high voltage and large electric current. In a gas blast circuit breaker, which is a final protective device for an electric power system, it is necessary to provide an insulation nozzle capable of withstanding high voltages.

To meet this requirement, a new nozzle construction has been proposed differing from a conventional nozzle with the new nozzle construction being achieved by advanced techniques of analysis such as a gas flow analysis.

In such a nozzle construction disclosed, for example, in Japanese Patent Unexamined Publication No. 60-218722 corresponding U.S. Pat. No. 4,667,072, a high-pressure gas region space is formed at a downstream side of a throat section of the nozzle by a normally-slanting surface which extends along the direction of flow of an extinguishing gas and a reversely-slanting surface intersecting this normally-slanting surface, and a region near a distal end portion of a stationary contact constitutes the high-pressure gas region until the stationary contact passes through this space position, thereby making it possible to enhance voltage performance.

One method of enhancing the internal arc resistance of the nozzle has been proposed, for example, in Japanese Patent Unexamined Publication No. 57-210507, in which 20% by volume of boron nitride (BN) is mixed as a filler in a fluoroplastic material of the nozzle.

With respect to the nozzle disclosed in the above-mentioned Japanese Publication 60-218722, it has been experimentally determined, as described in the specification thereof, that, the shape of the reversely-slanting surface and the diameter of the throat section greatly influence the dielectric interrupting performance.

On the other hand, in this type of nozzle, in order to enhance the internal arc resistance, it is necessary that boron nitride should be mixed in the nozzle material, as disclosed in the above-mentioned Japanese Publication 57-210507. In this case, however, it is not considered how much the energy lines of the arc intrude into the nozzle, and there exists a portion on the surface of the nozzle where the absorption of the arc energy is increased. This results in a drawback that the surface consumption by the arc is increased, and the above-mentioned nozzle construction suffers from the problems that the shape and size of the reversely-slanting surface are changed by the consumption with the surface result being that the intended performance can not be achieved after large electric current is interrupted many times.

SUMMARY OF THE INVENTION

It is an object of this invention to provide a gas blast circuit breaker having a nozzle construction which is capable of withstanding high voltages and is free from the lowering of its performance due to a consumption deformation even after the interruption of a large electric current.

In order to achieve the above object, the present invention provides a gas blast circuit breaker comprising an insulation nozzle for blowing extinguishing gas to an arc generated between a stationary contact with and a movable contact, the nozzle having a throat section into and out of which one of the two contacts is movable. A divergent section is provided down-stream of the throat section, and a slanting surface for increasing a reflectivity of energy intensity of the arc is formed on the divergent section of the nozzle. The nozzle is formed by adding not more than 15 vol. % of boron nitride powder as a filler to a fluoroplastic material.

When the movable contact moves away from the stationary contact, the energy lines readily radiated from the arc generated between these two contacts are decreased in an amount of intrusion of these energy lines into the nozzle by the slanting surface provided downstream of the throat section of the nozzle. As a result, an amount of boron nitride to be added can be reduced, and even in this case, the internal arc resistance of generally the same level as conventionally achieved can be maintained. Further, with the reduced amount of boron nitride, the surface deformation due to the consumption of the nozzle can be restrained, and therefore the same performance as obtained with a new nozzle can be achieved even after large electric current is interrupted many times.

DESCRIPTION OF THE EMBODIMENTS

Figure 1:
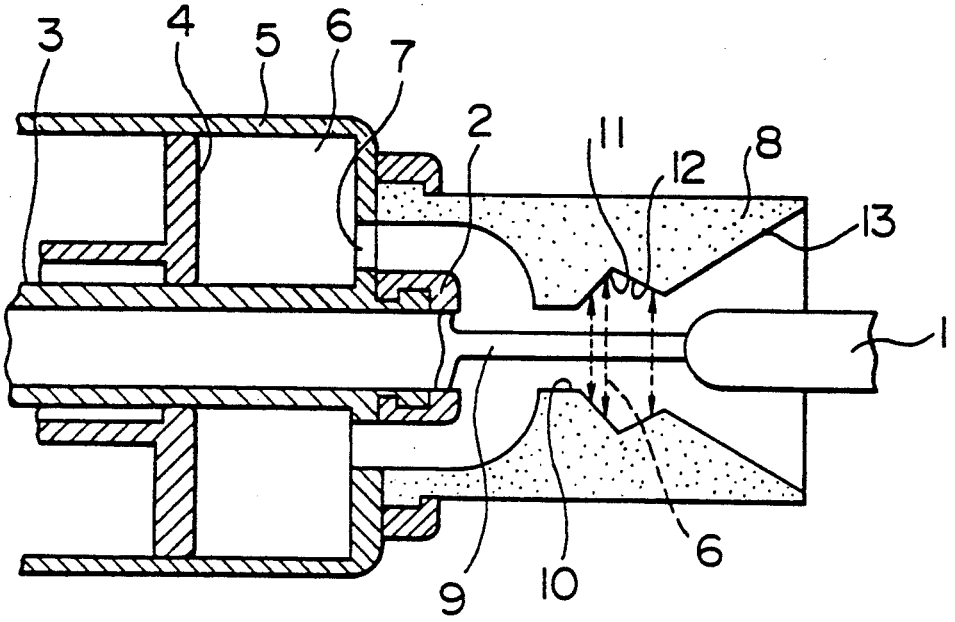
FIG. 1 is a vertical cross-sectional view of one embodiment of a gas blast circuit breaker of the present invention.

As shown in FIG. 1, a movable contact 2 is disposed in opposed relation to a stationary contact 1, and is movable into and out of contact with the stationary contact 1. A drive shaft 3 is connected to the movable contact 2, and a fixed piston 4 slidably supports the drive shaft 3. A movable cylinder 5 is mounted on the drive shaft 3 and encloses the fixed piston 4. A cylinder chamber 6 is defined by the fixed piston 4 and the movable cylinder 5. An opening 7 is formed through one end wall of the movable cylinder 5 disposed adjacent to the movable contact 2. A nozzle 8 is mounted on the movable cylinder 5, and this nozzle 8 serves to blow extinguishing gas, discharged from the cylinder chamber 6 through the opening 7, to an arc 9 generated between the contacts 1 and 2. The nozzle 8 includes a throat section 10 which fits on the stationary contact 1 with a slight gap therebetween upon movement of the movable cylinder 5, a first slanting surface 11 disposed downstream of the throat section 10 and extending along the direction of flow of the extinguishing gas so as to increase the reflectivity of the energy intensity of the arc, a second slanting surface 12 intersecting the first slanting surface 11, and a divergent section 13 extending from the second slanting surface 12. In order that the nozzle 8 can have insulating properties, the nozzle 8 is composed of a fluoroplastic material, and boron nitride (BN) is added to this fluoroplastic material as later described.

Figure 2:
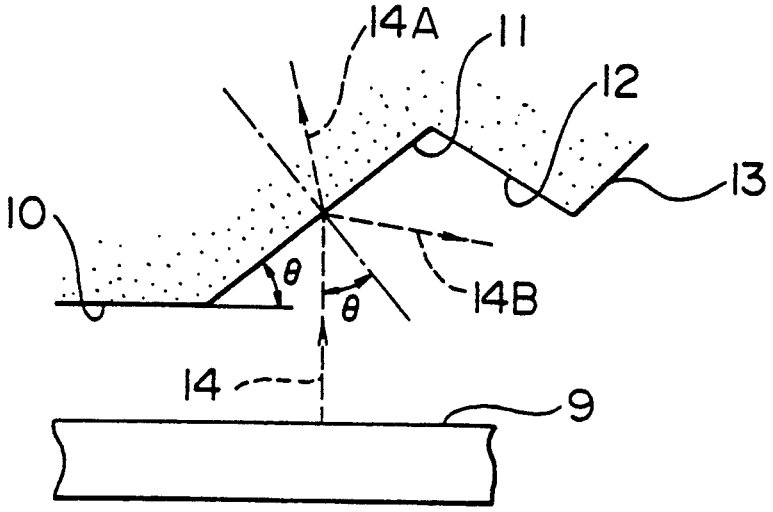
FIG. 2 is an enlarged, cross-sectional view of slanting surfaces of a nozzle of the embodiment shown in FIG. 1.

Next, the condition of reflection of an energy line 14 of the arc 9 by the first and second slanting surfaces 11 and 12 will be described with reference to FIG. 2. In FIG. 2, assuming that the angle between the first slanting surface 11 and the centerline (axis) of the nozzle 8 is 6, an energy line 14 from the arc 9 becomes an energy line 14A directed into the nozzle 8 and an energy line 14B obtained as a result of reflection by the first slanting surface 11. A reflectivity Io of the energy line intensity at this time is generally expressed by the following equations:

$$Io = K\left\{\frac{\sin(\theta - \alpha)}{\sin(\theta + \alpha)}\right\}^2 \quad (1)$$

$$\alpha = \sin^{-1}\left\{\sqrt{\frac{\epsilon 1}{\epsilon 2}} \cdot \sin\theta\right\} \quad (2)$$

where $\epsilon 1$ represents the dielectric constant of the gas, $\epsilon 2$ represents the dielectric constant of the nozzle and k is a optical constant.

Figure 3:
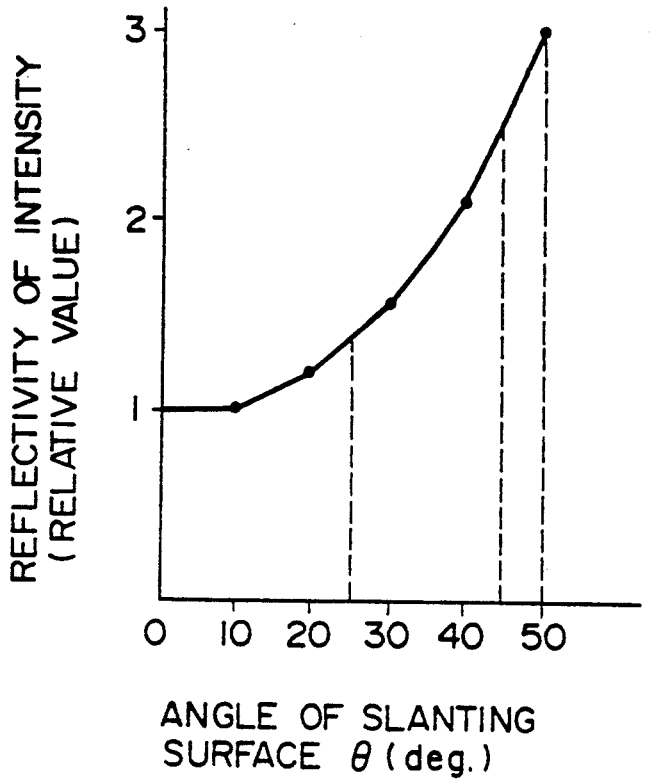
FIG. 3 is a graphical illustration of the relationship between the angle of the slanting surface of the nozzle of the gas blast circuit breaker of the present invention and the reflectivity of intensity of an arc energy line.

From the equations (1) and (2), in FIG. 3 is shown a relative value I (P.U.) of the reflectivity Io of the arc energy line intensity with respect to the angle $\theta$ of the slanting surface when the reflectivity at $\theta=0$ is equal to 1. The characteristics of the reflectivity of the energy line intensity shown in FIG. 3 are obtained when an amount of the boron nitride is 0%. The reflectivity of the arc energy line intensity obtained, for example, with the angle $\theta$ of 40° is twice as large as that obtained when the angle $\theta$ is equal to zero, and therefore with respect to the same arc energy line, the intensity of the energy line incident into the nozzle can be halved because the total arc energy is constant. Preferably, based on the characteristics curve shown in FIG. 3, the angle $\theta$ of the slanting surface should preferably be in a range of between 25° and 45°. When the angle $\theta$ of the slanting surface is 25°, the reflectivity of the energy line intensity is 1.4 times greater, as can be seen from FIG. 3. Therefore, by increasing the reflectivity of the energy line intensity 1.4 times in this manner, there can be obtained the effect equal to or greater than the effect that the incident energy line into the nozzle 8 is decreased by one grade with respect to the rated interrupting, current, for example, when the rating is decreased from 50 KA to 40 KA, this is represented by 50/40=1.3 times on the contrary, if the some energy line is maintained, the arc energy line must be increase, for example, from 40 kA to 50 kA. Therefore, there can be provided an ample margin of the performance for an internal arc resistance of the nozzle. On the other hand, from the viewpoint of the reflectivity of the energy line intensity, it is preferable that the angle $\theta$ of the slanting surface is larger. However, if the angle $\theta$ is too large, a vortex flow of the gas is produced in a space defined by the first and second slanting surfaces 11 and 12, and the gas density is decreased, and the withstanding voltage characteristics is decreased. Therefore, it has been determined from the gas flow analysis that the maximum angle $\theta$ the slanting surface should not be greater than 45°.

Next, reference is now made to the relation between the reflectivity of the arc energy line intensity and the amount of addition of the boron nitride.

Figure 4:
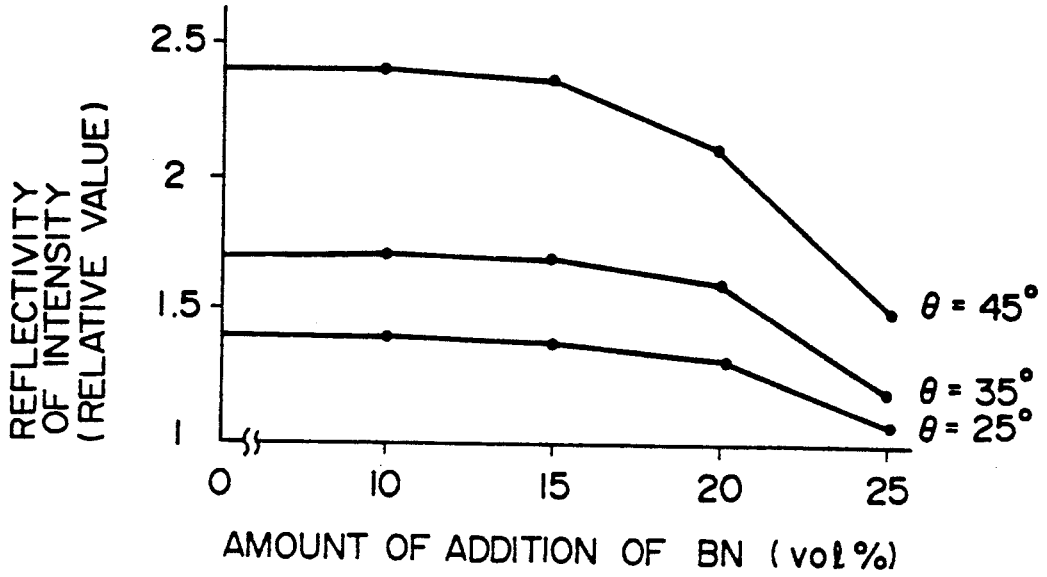
FIG. 4 is a graphical illustration of the relationship between the amount of boron nitride and the reflectivity of intensity of the arc energy line in the present invention.

When an amount boron nitride added to the nozzle is increased, the dielectric constant of the nozzle is increased, On the other hand, as is clear from equations (1) and (2), a square root of the dielectric constant of a substance is proportional to the index of refraction of the substance. This means that in the case of the same incident angle of the arc energy line, the greater the dielectric constant of the substance is, that is, the greater the amount of boron nitride added, the greater refraction the arc energy line penetrates into the substance. FIG. 4 illustrates a relationship of the amount of boron nitride (BN) added and the reflectivity of the arc energy line intensity with respect to the angle $\theta$ is the slanting surface of the nozzle. The reflectivity in the ordinate axis of FIG. 4 is expressed as the relative value obtained when the reflectivity at the angle (FIG. 3) of 0° is "1". As is clear from FIG. 4, when the amount of addition of the boron nitride is up to about 10 vol. %, the reflectivity at each angle shown in FIG. 3 is maintained, even when the angle $\theta$ of the slanting surface 11 is in the range of between 25° and 45°. When the amount of added boron nitride is 15 vol. %, the reflectivity is slightly decreased, but an effect similar to the effect that the rated interrupting current is decreased by one grade can be maintained. However, when the amount of boron nitride added is 20 vol. %, the reflectivity at each angle of the slanting surface is decreased, and the effect similar to the effect that the rated interrupting current is decreased by one grade cannot be maintained. In other words, by keeping the amount of boron nitride added to not more than 15 vol. %, the reflectivity at each angle of the slanting surface can be maintained.

Figure 5:
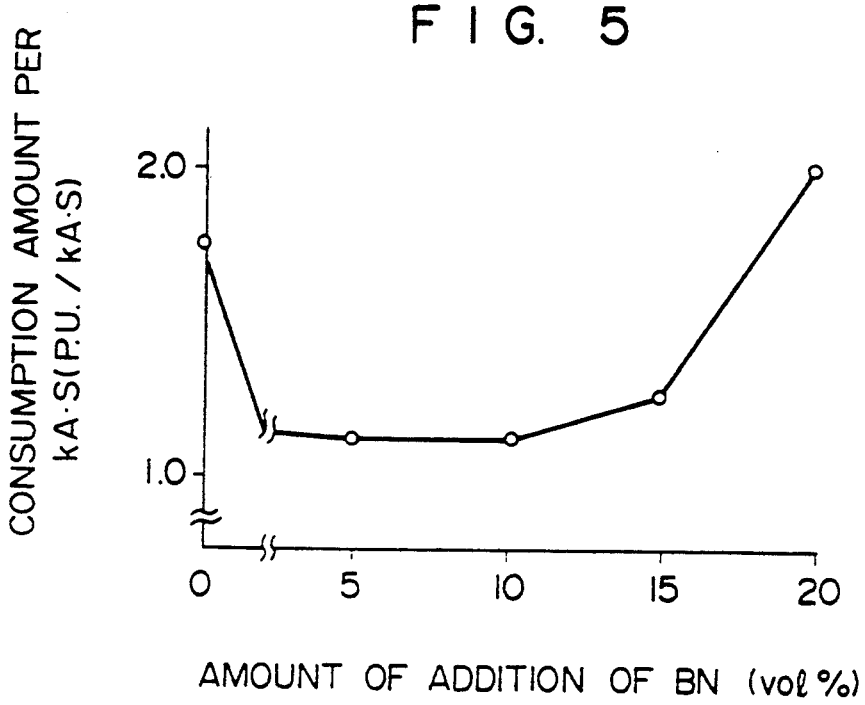
FIG. 5 is a graphical illustration of the relationship between the amount of boron nitride and the amount of consumption of the nozzle in the present invention.

To determine, the amount of surface consumption of the nozzle cylindrical test pieces were prepared, and an arc of 10 kAp was ignited in each test piece at a frequency of 0.5 cycle (60 Hz), and the nozzle consumption amount W (P.U./kA.S) at the electrode gap of 10 mm was measured. The results thereof are shown in FIG. 5. As is clear from FIG. 5, when the amount of boron nitride added is not more than 15 vol. %, there is no large difference in the consumption amount. However, particularly, the consumption amount at 20 vol. % of boron nitride is greatly different from the consumption amount at 15 vol. %. Incidentally, even at 0 vol. % of the boron nitride, the consumption amount is increased, and this is due to the formation of voids in the interior of the nozzle and a partial peeling at the surface, because the internal arc resistance of the nozzle is not provided.

In view of the above consumption amount, it is preferred that the amount of boron nitride added should be in the range of between 5 vol. % and 15 vol. %.

With the above construction, by providing the first and second slanting surfaces 11 and 12 downstream of the throat section 10 of the nozzle, the extinguishing gas can be always applied to the surface of that portion of the stationary contact subjected to an increased electric field, and the transient withstanding voltage after the current interruption can be maintained. And besides, by suitably determining the angles of the first and second slanting surfaces and the amount of boron nitride, the internal arc resistance of the nozzle can be enhanced, and the consumption amount can be restrained. As a result, a gas blast circuit breaker is provided which enables the interruption of small capacitive current after a frequent interruption of a large current.

Figure 6:
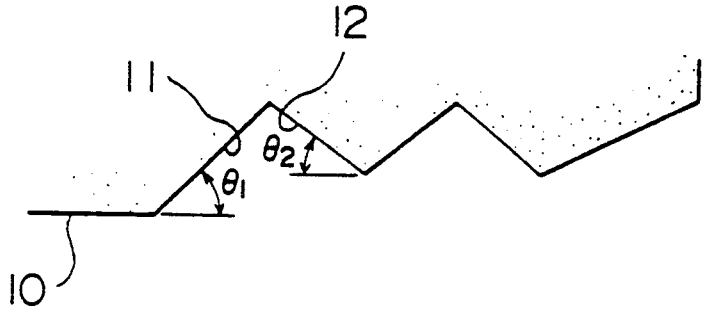
FIG. 6 is an enlarged cross-sectional view showing another embodiment of slanting surfaces in a gas blast circuit breaker of the present invention.

The above-mentioned embodiment of the invention has been described without particularly distinguishing between the angles $\theta 1$ and $\theta 2$ of the end portions of the first and second slanting surfaces 11 and 12 as shown in FIG. 6. However, the effects can be expected even if only one of the angles $\theta l$ and $\theta 2$ is set to the above range of the present invention. Namely, if the internal arc resistance is increased at the first slanting surface 11 or the second slanting surface 12, the dielectric interrupting performance is enhanced at the surface thereof. Further, by such setting, the degree of freedom of setting of the angles $\theta l$ and $\theta 2$ of the slanting surfaces is increased, and the angle-setting for controlling the flow of gas to the stationary contact can be easily done.

In the present invention, as shown in FIG. 6, a plurality of pairs of first and second slanting surface 11, 12 can be provided. In this case, the angle-setting is done in the same manner as described above.

Since the amount of incidence of the arc energy line is larger at the throat section 10 of the nozzle 8 than at the slanting surfaces in the present invention, the amount of boron nitride added at the throat section 10 can be 20 vol. % to increase the internal arc resistance at the throat section 10 so as to restrain the surface deformation due to the consumption.

According to the present invention, by suitably determining the angle of the slanting surface disposed downstream of the throat section of the nozzle, as well as the amount of boron nitride, there can be provided a nozzle capable of withstanding high voltages which is free from deformation of its surface configuration which would be caused by the consumption after a frequent interruption of large electric current.

What is claimed is:

1. A gas blast circuit breaker comprising:

an insulation nozzle for blowing an extinguishing gas to an arc generated between a stationary contact and a movable contact, said insulation nozzle having a throat section into and out of which one of said two contacts is movable and a divergent section provided downstream of said throat section, wherein at least one slanting surface for increasing a reflectivity of energy intensity of the arc is formed intermediate said throat section and said divergent section of said nozzle, and wherein said nozzle is fashioned of a fluoroplastic material impregnated with a filler material of boron nitride powder in an amount not more than 15 vol. %, whereby an amount of surface deformation of the nozzle due to consumption of the nozzle by the arc can be restrained.

2. A gas blast circuit breaker according to claim 1, wherein said slanting surface includes a first slanting surface extending in a flow direction of said extinguishing gas, and a second slanting surface intersecting said first slanting surface.

3. A gas blast circuit breaker according to claim 2, wherein one of an angle between said first slanting surface and a centerline of said nozzle and an angle between said second slanting surface and the centerline of said nozzle is in a range of between 25° and 45°.

4. A gas blast circuit breaker according to claim 1, wherein the amount of boron nitride is in the range of 5 vol. % to 15 vol. %.

5. A gas blast circuit breaker comprising:

an insulation nozzle for blowing an extinguishing gas to an arc generated between a stationary contact and a movable contact, said nozzle having a throat section into and out of which one of said two contacts is movable; and a divergent section provided downstream of said throat section, wherein a slanting surface for restraining arc energy intruding into said nozzle is provided intermediate said throat section, and said divergent section of said nozzle, and wherein said nozzle is fashioned of a fluoroplastic material impregnated with a filter material of boron nitride powder in an amount not more than 15 vol. %, and a dielectric constant of said nozzle is greater than that of said extinguishing gas, whereby an amount of surface deformation of the nozzle due to consumption of the nozzle by the arc can be restrained.

6. A gas blast circuit breaker according to claim 4, wherein the amount of boron nitride is in the range of 5 vol. % to 15 vol. %.

* * * * *